United States Patent [19]

Jailor

[11] Patent Number: 5,047,597

[45] Date of Patent: Sep. 10, 1991

[54] VACUUM CLEANER SWITCH

[75] Inventor: John J. Jailor, North Ridgeville, Ohio

[73] Assignee: The Scott Fetzer Company, Westlake, Ohio

[21] Appl. No.: 466,668

[22] Filed: Jan. 17, 1990

Related U.S. Application Data

[62] Division of Ser. No. 203,430, Jun. 7, 1988, Pat. No. 4,905,343.

[51] Int. Cl.[5] ..... H01H 9/00; A47L 9/28

[52] U.S. Cl. ..... 200/5 B; 15/319; 200/61.62

[58] Field of Search ..... 15/328, 319, 332, 334, 15/339; 200/5 R, 5 B, 5 E, 50 A, 52 R, 61.62, 318.2, 51.09, 51.1

[56] References Cited

U.S. PATENT DOCUMENTS

| | | | |
|---|---|---|---|
| 3,319,282 | 5/1967 | MacFarland | 15/334 X |
| 3,396,247 | 8/1968 | Rankin | 200/5 B |
| 3,678,288 | 7/1972 | Swanke et al. | 200/5 EA X |
| 4,336,626 | 6/1982 | Hone et al. | 15/339 |
| 4,398,316 | 8/1983 | Scott et al. | 15/339 X |
| 4,529,852 | 7/1985 | Lewandowski | 200/51.09 X |

*Primary Examiner*—J. R. Scott

*Attorney, Agent, or Firm*—Watts, Hoffmann Fisher & Heinke

[57] ABSTRACT

A control switch is disclosed for a two-speed vacuum cleaner motor and the like. The switch provides three sensors which operate in response to the mounting of three different types of accessories on a vacuum cleaner. One sensor causes low motor speed operation when an accessory is mounted requiring low speed operation. Another sensor operates to provide high speed motor operation when a high speed accessory is mounted. The third sensor prevents motor operation when an accessory is not mounted on the outlet of the vacuum cleaner. The control switch provides a high speed/low speed switch and a power switch. The power switch is automatically moved to its open or OFF position in response to the mounting of an accessory. Consequently, the high speed/low speed switch cannot oeprate ot start the motor, and is therefore provided with low cost contacts. The control switch and motor provide plug-type connectors which automatically connect the internal motor wiring when the switch is installed.

9 Claims, 13 Drawing Sheets

VACUUM CLEANER SWITCH

This is a division of application Ser. No. 07/203,430, filed June 7, 1988 now U.S. Pat. No. 4,905,343.

BACKGROUND OF THE INVENTION

This invention relates generally to control switches, and more particularly to an improved control switch for appliances such as suction cleaners and the like.

Prior Art

It is known to provide suction cleaners with electric motor-driven fans that operate at a first low speed for cleaning operations using a removable first attachment, such as a rug cleaning nozzle having a powered brush or beater, and that operate the fan at a second high speed to create more suction when the cleaner is used with removable attachments which rely upon suction or vacuum alone to remove dirt or dust.

It is also known to provide a speed selector switch which automatically changes the motor speed in response to the mounting of a given attachment on the cleaner so that the fan automatically operates at the correct speed for the particular attachment which is mounted on the cleaner.

It is also known to arrange the speed selector switch so that the fan motor cannot run unless an attachment is mounted at the suction end of the cleaner. Examples of suction cleaners providing such controls are illustrated and described in U.S. Pat. Nos. 3,319,282; 4,336,626; and 4,398,316 (all assigned to the assignee of the present invention). Such patents are incorporated herein by reference in their entirety.

In each of these systems, the speed control switch is separate from the main power switch, which is manually operated by the cleaner user to start and stop the cleaner. In such systems, the installation of an attachment while the main power switch is in its ON position causes the selector switch to start the motor. Similarly, if an attachment is removed while the motor is running, the selector switch operates to stop the motor. Consequently, the contacts for the selector switch can operate to start and stop the motor. Therefore, the contacts of the selector switch must be of sufficient quality to withstand motor starting and stopping functions.

Further, the motor can start, in some instances, before the attachment is fully installed, making it difficult to complete the installation of the attachment. Additionally, such systems only function in response to the installation or removal of an attachment from the suction end of the cleaner. Therefore, cleaner operation can occur even when a filter bag or other attachment is not mounted at the discharge end of the cleaner.

SUMMARY OF THE INVENTION

There are a number of aspects to the present invention. In accordance with one important aspect of this invention, a manually operable power switch is combined with a speed selector switch so that a single switch system functions to automatically establish the proper motor speed for the particular attachment mounted on the cleaner, and also provides a switch structure for manually turning the cleaner motor on and off.

In accordance with another aspect of this invention, a switch system is provided for motor-driven suction cleaners or the like combining a manually operable power switch and a speed selector switch in which the speed selector switch cannot operate to start and stop the motor. Since the speed selector switch contact cannot be operated to start and stop the motor, less expensive contacts can be provided in the selector switch.

In accordance with another important aspect of this invention, a combined power and speed selector switch is provided for suction cleaners or the like in which the motor cannot start unless the power switch is manually operated to an ON position after the attachment is installed.

In accordance with still another important aspect of this invention, a combined power switch and speed selector switch is provided for suction cleaners or the like in which one or more of the power switch contacts is disabled when an attachment is not properly mounted on the cleaner. This prevents motor operation unless an attachment is properly mounted on an associated cleaner.

In accordance with a still further important aspect of this invention, a power switch is provided for suction cleaners or the like in which the mounting of the attachment on the cleaner automatically moves the power switch to its open motor OFF position. The illustrated embodiment of this invention provides a control switch system for vacuum cleaners and the like having a double-pole power switch and a speed selector switch mounted within a single body. The power switch is a manually operable switch which sequentially moves between an ON and an OFF position each time the switch operator is manually operated. The speed selector switch operates automatically to provide the proper fan speeds for the attachment or attachments mounted on the cleaner.

For example, when a carpet cleaning nozzle attachment having a beater brush is mounted on the cleaner, the selector switch causes the motor and fan to operate at a slower speed. Conversely, when an attachment which relies entirely on vacuum to pick up dirt or dust is mounted on the cleaner, the selector switch automatically causes the motor and the fan to operate at a higher speed.

Sensors are provided which are engaged by the mounted attachment and which move the selector switch between its high speed and low speed conditions so that the motor is automatically operated at the proper speed for the particular attachment which is mounted on the cleaner. These same sensors also move one contact of the power switch to a position in which the main power switch is open except when an attachment is mounted on the suction end of the cleaner.

The illustrated embodiment also provides a sensor which prevents motor operation when an attachment is not mounted on the outlet or blower end of the cleaner. Such outlet attachment may, for example, be a filter bag or any other attachment which utilizes cleaner exhaust air for its operation.

This outlet sensor also functions to move one of the power switch contacts to a position in which the main power switch is open to prevent motor operation when an attachment is not mounted on the cleaner outlet. Therefore, the cleaner cannot operate unless attachments are mounted both on the cleaner inlet and the cleaner outlet.

In the illustrated embodiment in which the power switch is a double-pole switch, the sensors at the suction end of the cleaner move a contact which is part of one switch pole of the switch to an open or disabled position and a sensor on the outlet moves a contact which is part of the other switch pole to its open or disabled position when associated accessories are not mounted.

Further, the illustrated embodiment provides a double-pole switch in which each pole includes two movable contacts. One movable contact of each pole is moved by a sensor in response to the mounting or removal of an attachment. The other movable contact of each pole is moved by the manually operated switch operator.

In the illustrated embodiment, the sensors each provide a finger which automatically moves the switch operator of the power switch to its switch-open position in response to the mounting of any attachment. Therefore, the motor cannot start while an attachment is being mounted. Consequently, there is no interference with the mounting of an attachment by the premature starting of the motor. In the illustrated embodiment, the motor can only be started by the manual operation of the power switch after attachments are mounted on both the inlet and the outlet of the cleaner.

With this invention, an efficient, reliable, and low-cost switch system is provided which is particularly suited for use on suction cleaners having removable attachments.

These and other aspects of this invention are illustrated in the accompanying drawings, and are more fully described in the following specification.

DETAILED DESCRIPTION

Figures 1, 1A:
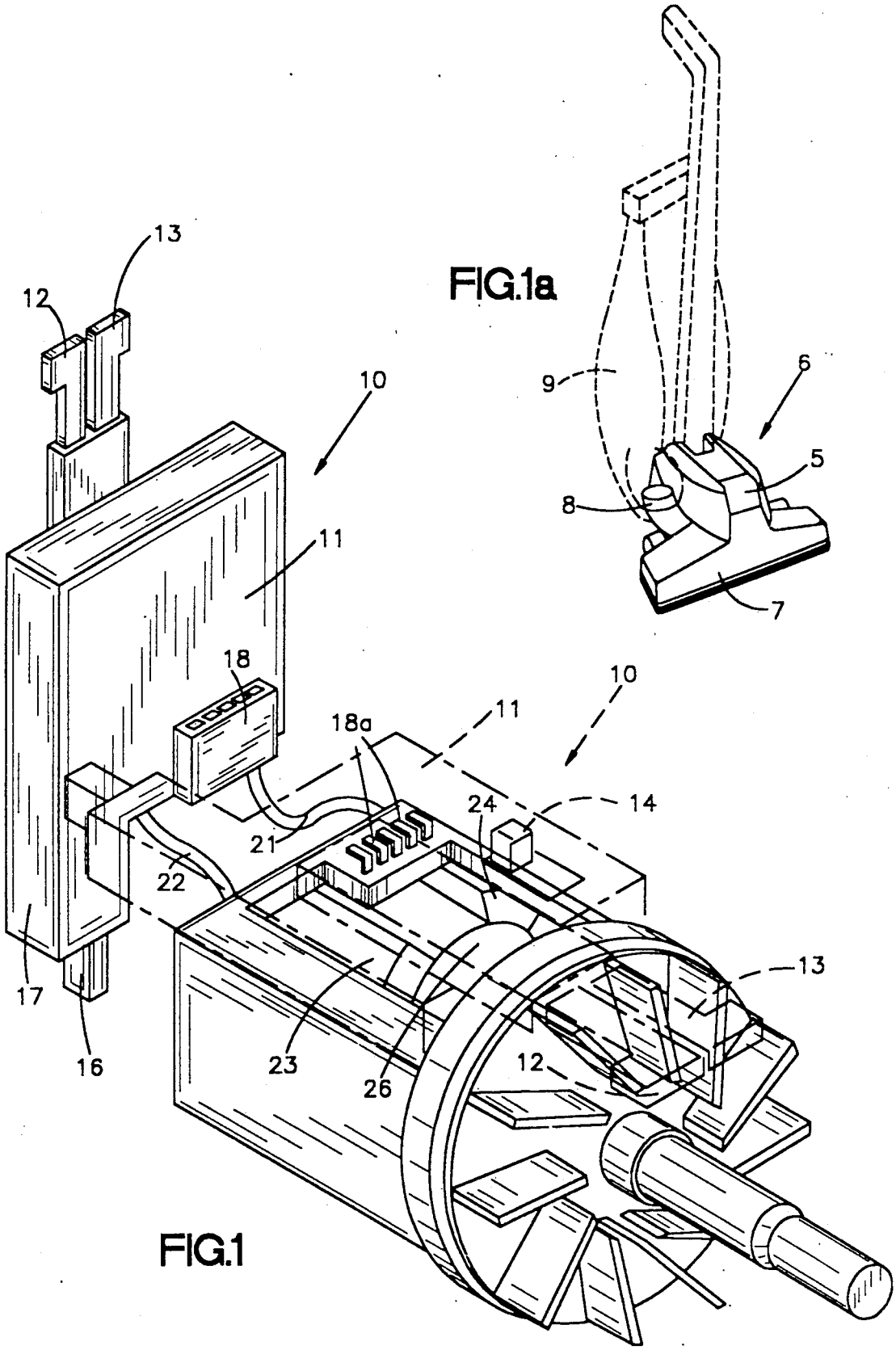
FIG. 1 is a view of a switch in accordance with this invention and a typical motor and fan unit illustrated in full-line prior to installation of the switch on the motor and in phantom illustrating the position of the switch mounted on the motor.
FIG. 1*a* is a perspective view of a vacuum cleaner providing a switch and motor fan unit illustrated in FIG. 1.

FIG. 1 illustrates a control switch 10 incorporating the present invention prior to its installation on the motor. The switch provides a switch body 11 having two forwardly extending sensors 12 and 13 which are longitudinally movable with respect to the body 11 between an extended position which they assume when an accessory is not mounted on the inlet 5 of the cleaner 6 (illustrated in FIG. 1*a*) and retracted positions to which they move in response to engagement with an inlet accessory 7 mounted on the cleaner. As described in detail below, the sensor 12 is engaged and moved to its retracted position by an accessory requiring high speed motor operation. The sensor 13 is engaged and moved to its retracted position by an accessory requiring low speed motor operation.

In addition, an outlet sensor 14 extends from the switch body 11 and is movable relative thereto between a retracted position which it assumes when an accessory is not mounted on the outlet 8 of the cleaner and an extended or operative position which it assumes when it is engaged and moved to the extended position by an accessory 9 mounted on the outlet 8 of the cleaner.

Finally, the switch provides a power switch operator 16 which extends from the body 10 and is longitudinally movable to sequentially operate a power switch contained within the control in a stepwise manner. A power switch operator is connected to a manually operated ON/OFF switch pedal on the cleaner, and each time the pedal is depressed, the power switch is opened or closed, provided the proper accessories are mounted. Also provided on a control switch is an electrical power receptacle 17 for connection with the power cord for the cleaner.

The underside of the power switch provides plug-in type connectors 18 which mate with connectors 18*a* on the motor body so that the mounting of the switch on the body automatically provides most of the electrical connections with the motor. In addition, two wire leads 21 and 22 extend from the switch body to provide connections with the armature brushes 23 and 24 (illustrated in FIGS. 2A and 2B) which connect to the armature 26 of the motor. Consequently, the control switch 10 can be easily mounted on the motor and the electrical connections between the switch and the motor are completed by merely connecting the wire leads 21 and 22 to the associated armature brushes 23 and 24.

It should also be understood that suitable linkages are provided to connect the sensors 12 through 14 and the main switch operator 16 for operation of each of them when an appropriate accessory is installed and to connect to the ON/OFF switch button of the cleaner. For purposes of simplicity, such linkages are not illustrated herein, but their arrangement and operation are within the ordinary skill of persons in the art.

Figure 2:
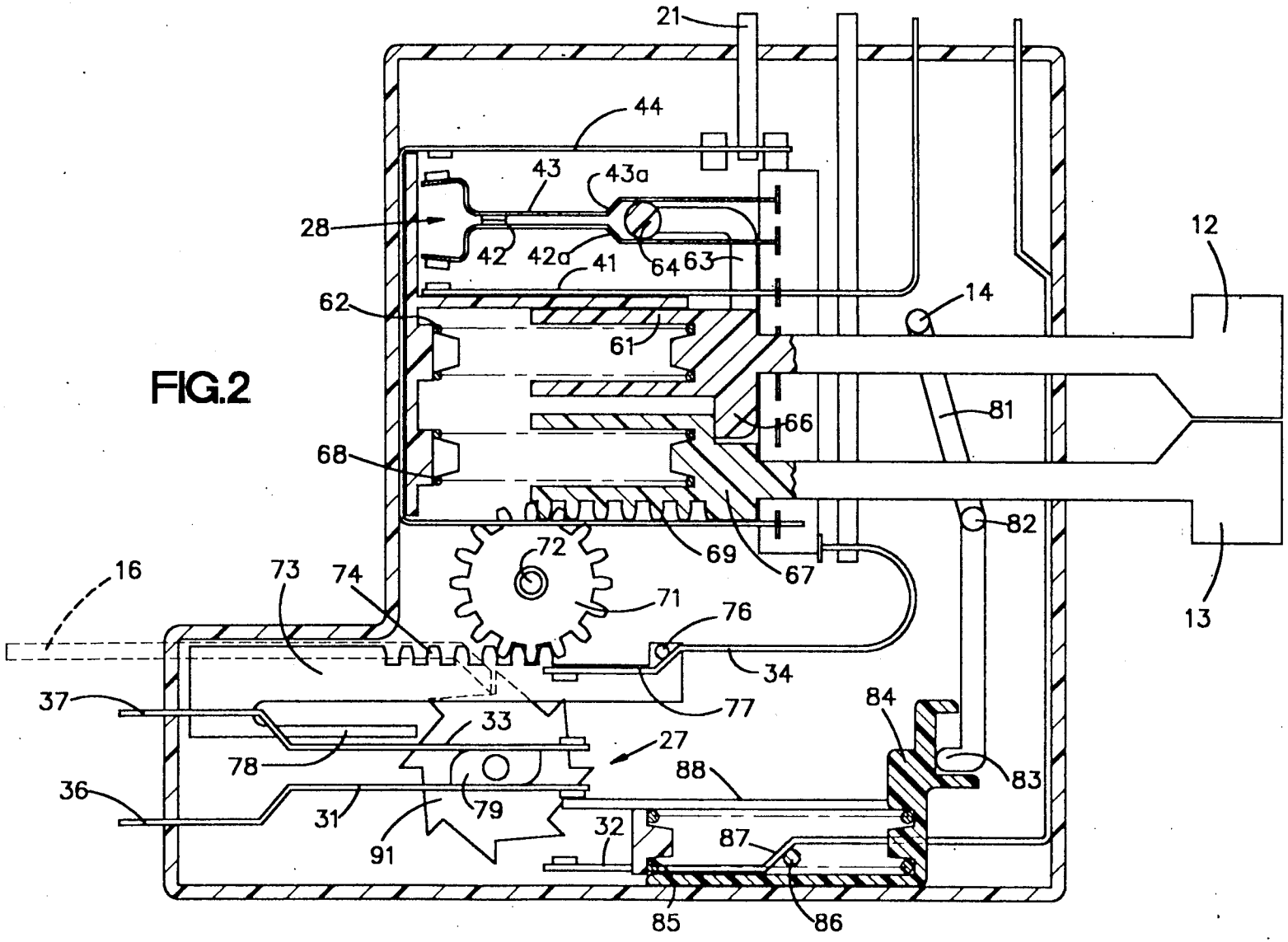
FIG. 2 is a plan view, with parts removed for purposes of illustration, showing the position of the switch components when accessories are not installed on either the inlet or the outlet of the cleaner and when the main power switch is in the OFF position.
Figure 2A:
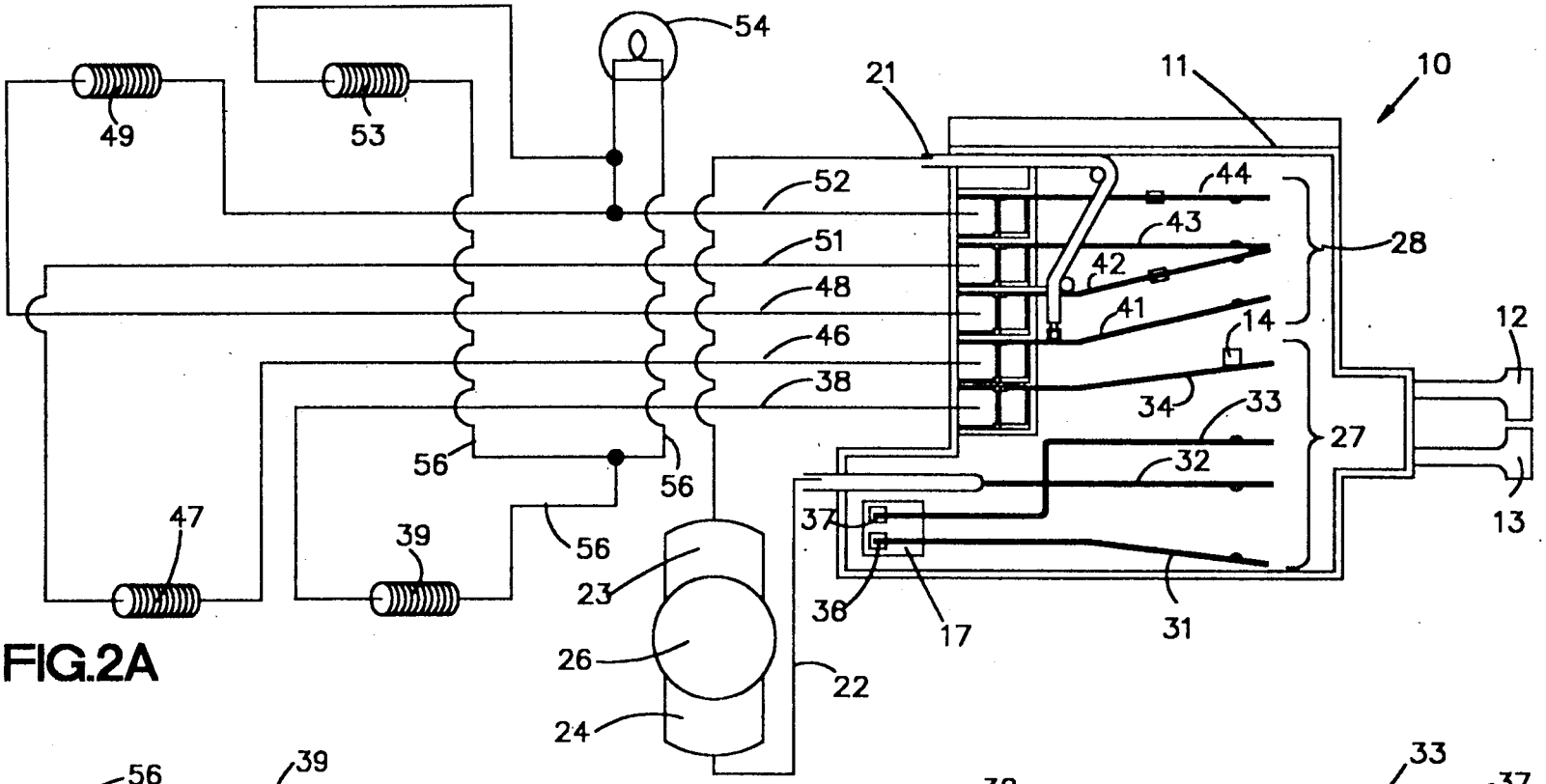
FIG. 2A is a line diagram of the motor and switch in the condition of FIG. 2.
Figure 2B:
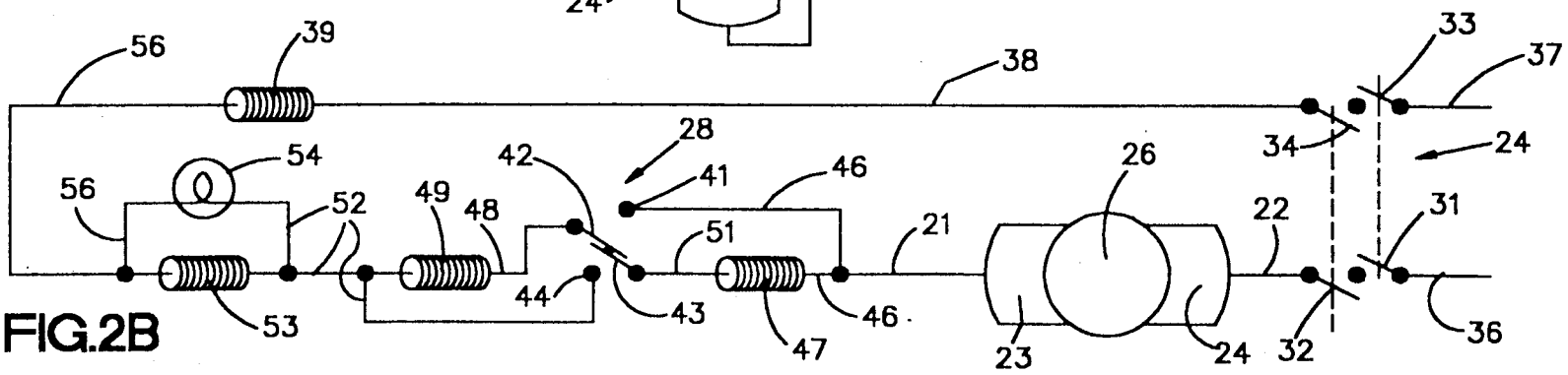
FIG. 2B is a schematic wiring diagram illustrating the condition of FIGS. 2 and 2A.

Reference should now be made to FIG. 2, which illustrates the basic structure of the control switch, and to FIGS. 2A and 2B, which illustrate the switch in combination with a two-speed series parallel motor. In FIGS. 2, 2A, and 2B, the switch components are illustrated in the condition they assume when an accessory is not mounted on either the inlet or the outlet, and in which the main power switch is in the OFF position.

Referring to FIGS. 2A and 2B, a control switch provides two basic switch systems. One is the main power switch 27, and the other is the high-speed/low-speed switch 28. The power switch is a double-pole switch having four separate, movable contact support arms 31, 32, 33, and 34. The contact support arm 31 connects to one side 36 of the power supply, and the contact support arm 33 is connected to the other side 37 of the power supply. The contact support arm 32 is connected to the wire lead 22, and the contact support arm 34 is connected through internal motor winding line 38 to one side of a field coil 39.

The high-speed/low-speed switch 28 also includes four contact support arms 41, 42, 43, and 44. In this switch, the two contact support arms 41 and 44 are not movable and the two contact support arms 42 and 43 are movable.

The contact support arm 41 is connected to the wire lead 21 and is also connected to internal motor wiring indicated at 46 to one end of a second field winding 47. The contact support arm 42 is movable and connects through internal motor wiring indicated at 48 to one end of a third field coil 49. The contact support arm 43 is also movable and is connected through internal motor wiring indicated at 51 to the other end of the field coil 47.

The contact support arm 44 is connected through internal motor wiring indicated at 52 to the other end of the field coil 49, one end of a fourth field coil 53 and one side of a cleaner headlight 54. The other side of the cleaner headlight 54 is connected by internal motor wiring 56 to the other side of the coil 39 and the other side of the coil 53. In the condition illustrated in FIGS. 2A and 2B, the two movable contact support arms 42 and 43 engage and all of the field coils 47, 49, 52, and 39 are connected in series. This is the manner in which the field coils are energized for slow speed operation of the motor. However, as best illustrated in FIGS. 2A and 2B, the power switch 24 is open, so motor operation does not occur.

Referring to FIG. 2, the low-speed sensor 13 extends into the body 10 and is connected at its inner end with a first slide member 61. This slide member 61 is biased to the right, as viewed in FIG. 2, by a spring 62. The sensor 12 is also provided with a first leg 63 having an upstanding projection 64 extending up between two movable contact support arms 42 and 43 adjacent to offsets therein **42*a* and 42*b*. The sensor 12 is also provided with a second leg 66 extending into alignment with an engaging and mating surface on a second slide 67. The slide 67 is also biased to the right, as viewed in FIG. 2, by a spring 68**.

The inner end of the second sensor 13 connects with the end of the second slide 67 and is normally held in an extended position by the spring 68, as illustrated in FIG. 2.

The second slide 67 is formed with gear teeth 69 which mesh with the teeth of a gear 71 pivoted in the switch body for rotation about the axis 72. Mounted within the switch body 10 is a third slide 73, also formed with gear teeth 74 which mesh with the opposite side of the pivoted gear 71. The interconnection between the two slides 67 and 73 provided by the pivoted gear 71 causes the slide 73 to move to the right, as viewed in FIG. 2, when the slide 67 moves to the left.

The slide 73 is provided with an upstanding projection 76 which engages an offset 77 in the contact support arm 34 and allows the contact support arm 34 to move to a disabled position, illustrated in FIG. 2. However, movement of the slide 73 to the right, as viewed in FIG. 2, in response to the installation of an accessory on the inlet of the cleaner causes the projection to move to the right and deflect the contact support arm 34 in an anticlockwise direction to an enabled position in which such contact support arm can be engaged by the contact support arm 33.

The slide 73 also provides a resilient pusher or finger 78 which operates to engage the power switch operating cam 79 and move it to the OFF position illustrated in FIG. 2 if the power switch operating cam is in the ON position when an accessory is being mounted on the inlet of the cleaner. This prevents the premature starting of the motor during installation of an accessory on the inlet of the cleaner by automatically moving the power switch operating cam to its OFF position as an accessory is mounted on the inlet of the cleaner.

The outlet sensor 14, which projects beyond the face of the switch body, is provided by an outlet sensor lever 81 pivoted in the switch body 10 for pivotal oscillating movement about an axis 82. This lever at its opposite end is provided with a projection 83 which engages a fourth slide 84 biased to the right as viewed in FIG. 2 by a spring 85. This slide 84, like the slide 73, is provided with an upstanding projection 86 which engages an offset 87 in the contact support arm 32. Here again, the spring arm 32 and the projection 86 are proportioned so that the spring arm 32 moves to its disabled position when the slide 84 is in its righthand position, which it assumes when an accessory is not mounted on the outlet of the cleaner. However, when the slide 84 moves to the left in response to the mounting of an accessory on the outlet of the cleaner, the projection 86 moves the contact support arm 32 to its enabled position, in which it can be engaged by the contact support arm 31.

This slide also provides a flexible pusher finger 88 which is engageable with the power switch operating cam 79 and operates to move such cam to the power switch open position illustrated in FIG. 2 when it moves to the left as viewed in FIG. 2 during the installation of an accessory on the cleaner outlet.

The power switch operating cam is rotated through 90 degrees in a stepwise manner each time the power switch operator 16 is moved to the right through an engagement between the power switch operator 16 and a step switch operating wheel 91.

Operation

In the condition illustrated in FIGS. 2, 2A, and 2B, the power switch 24 is open and the high-speed/low-speed selector switch 28 connects the four field coils 47, 49, 53, and 39 in series for low-speed operation of the motor. However, in such condition, in which there are no accessories installed on either the inlet or the outlet of the cleaner, the sensors 12 and 13 are extended and the sensor 14 is in its non-operative position. In such condition, the two contact support arms 31 and 34 are both in their disabled position so that if the power switch operating cam were rotated to a switch-on position in which it extended perpendicular to the illustrated position of FIG. 2, the movable contact support arms 32 and 33 would not engage the associated contacts 31 and 34. Therefore, even if the power switch were operated to a closed position, it would not cause operation of the motor.

Figure 3:
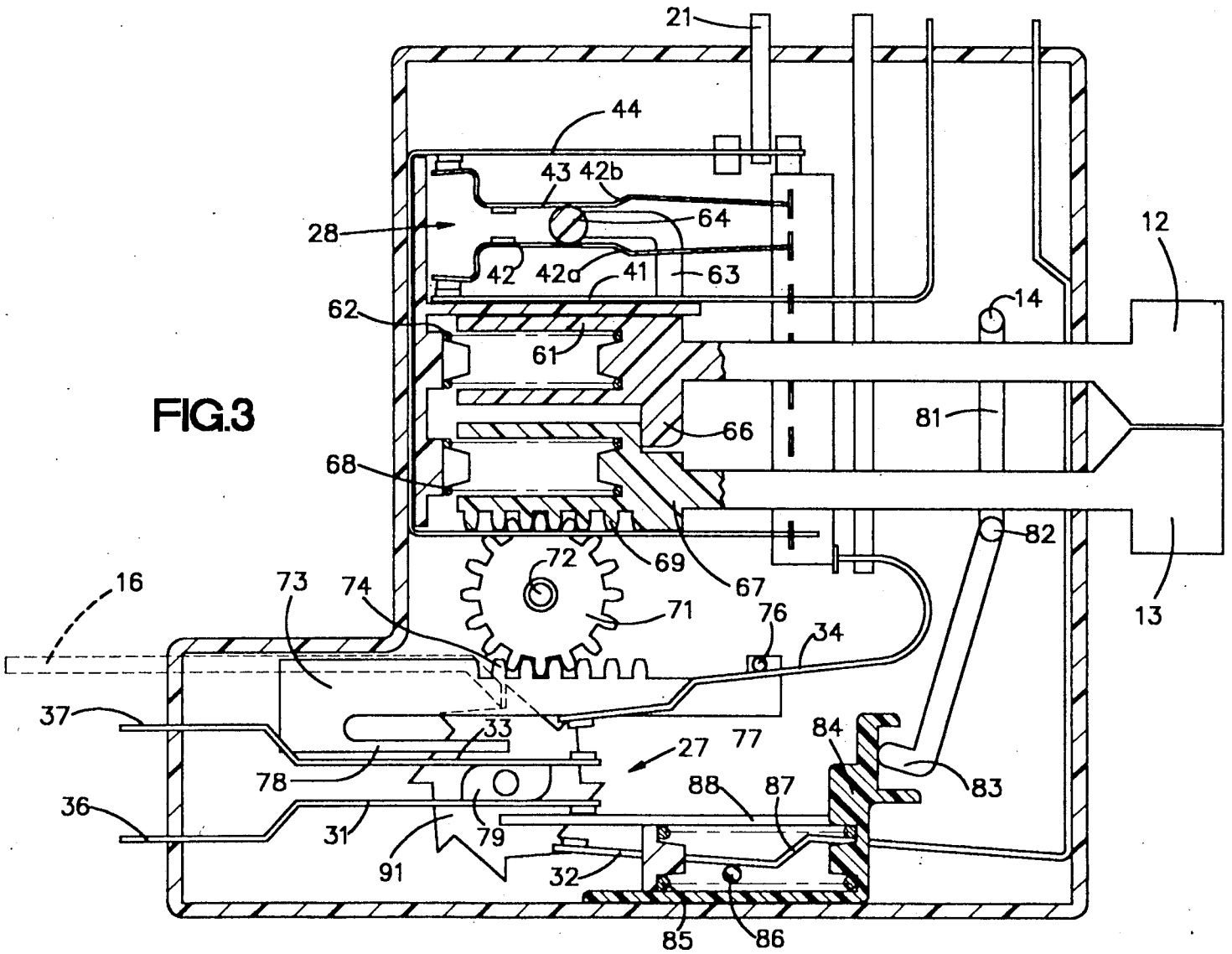
FIGS. 3, 3A, and 3B are respectively similar to FIGS. 2, 2A, and 2B, but illustrate the condition in which a high-speed accessory is mounted on the inlet of the cleaner, and accessory is mounted on the outlet of the cleaner, and the power switch is in the OFF position.
Figure 3A:
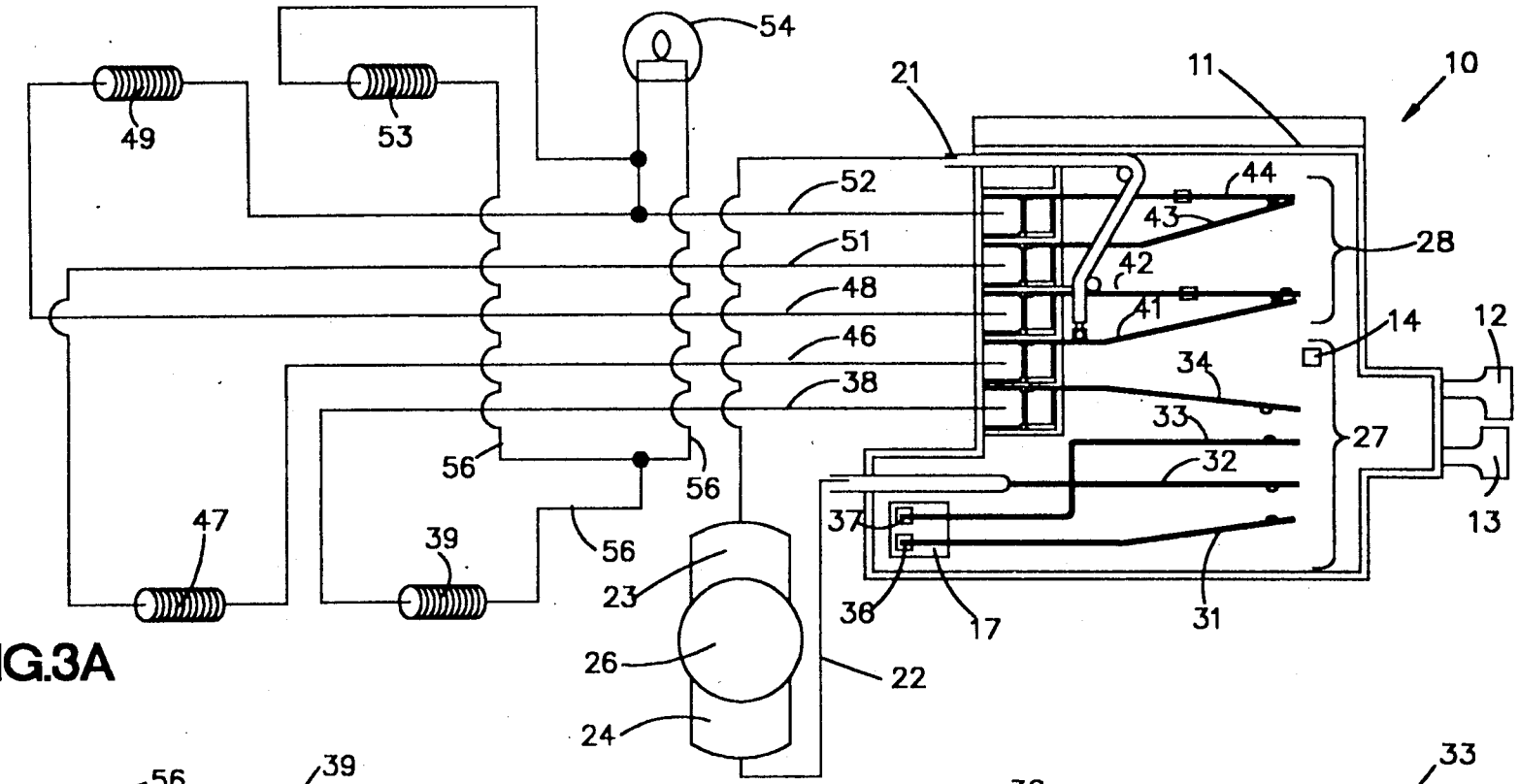
Figure 3B:
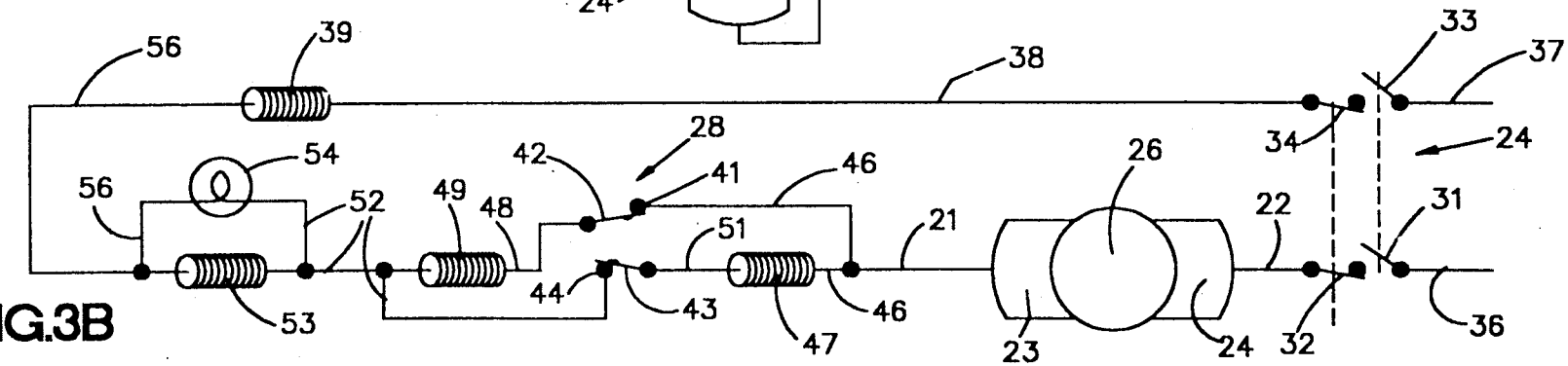

FIGS. 3, 3A, and 3B illustrate the condition of the operating switch when a high-speed accessory is mounted on the inlet of the cleaner and an outlet accessory is mounted on the outlet of the cleaner. When the high-speed accessory is mounted on the inlet of the cleaner, it causes the high-speed sensor 12 to move to the left. Such movement moves the projection 64 past adjacent offsets 42*a* and 43*a* in the two contact support arms 42 and 43, causing the contact support arm 42 to move into engagement with the contact support arm 41, and also causing the contact support arm 43 to move into engagement with the contact support arm 44. This changes the condition of the high-speed/low-speed switch from the series connection of the field coils of the motor to a high-speed connection in which the two field coils 47 and 49 are connected in parallel with the two parallel connected coils 47 and 49 in series with the coils 53 and 39 for high-speed operation of the motor.

The movement of the high-speed sensor 12 to the left also operates through the second leg 66 to move the second slide 67 to the left. This, in turn, through the action of the gear 71, moves the slide 73 to the right, causing its projection 76 to move the contact support arm 34 to its enabled position in which it can be engaged by the power switch contact support arm 33. If, for any reason, the power switch operating cam 79 is in the ON position during the installation of an accessory on the inlet, the movement of the slide 73 to the right causes the pusher finger 78 to automatically turn the power switch operating cam to an OFF position prior to the movement of the contact support arm 34 to its enabled position. This ensures that the motor will not prematurely start during the installation of an accessory on the inlet.

In FIG. 3, the outlet accessory sensor 14 is also moved to its operative position in which the slide 74 has been moved to the left. In such position, the contact support arm 32 of the power switch is moved to its enabled position, in which it can be engaged by the contact support arm 31 when the power switch is turned to an ON position by the rotation of the power switch operating cam 79.

Here again, however, if the power switch operating cam 79 is in an ON position at the time the accessory is being installed on the outlet of the cleaner, the pusher finger 88 automatically operates to move the power switch operating cam 79 to its OFF position before the contact support arm 32 is moved to its enabled position. Therefore, premature starting of the motor cannot occur during the installation of an outlet accessory.

In the condition illustrated in FIG. 3, in which an accessory is mounted on both the cleaner inlet and the cleaner outlet, it is merely necessary to rotate the power switch operating cam 79 through 90 degrees by moving the power switch operator 16 inwardly and the motor commences at that time to rotate at high speed.

Figure 4:
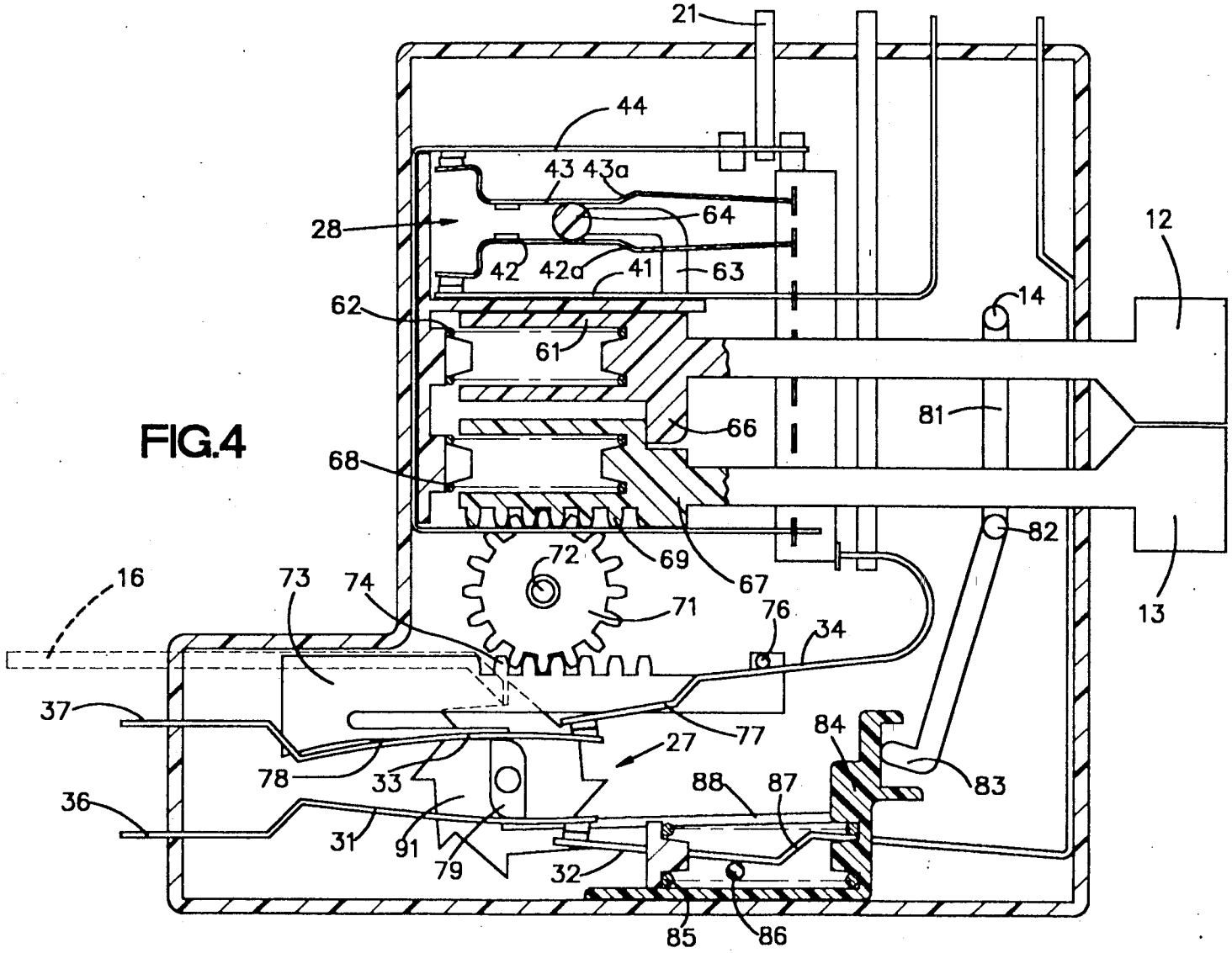
FIGS. 4, 4A and 4B are respectively similar to the corresponding preceding figures, but illustrate the switch in a condition in which a high-speed accessory is mounted on the inlet of the cleaner, an accessory is mounted on the outlet of the cleaner, and the power switch is in the ON position.
Figure 4A:
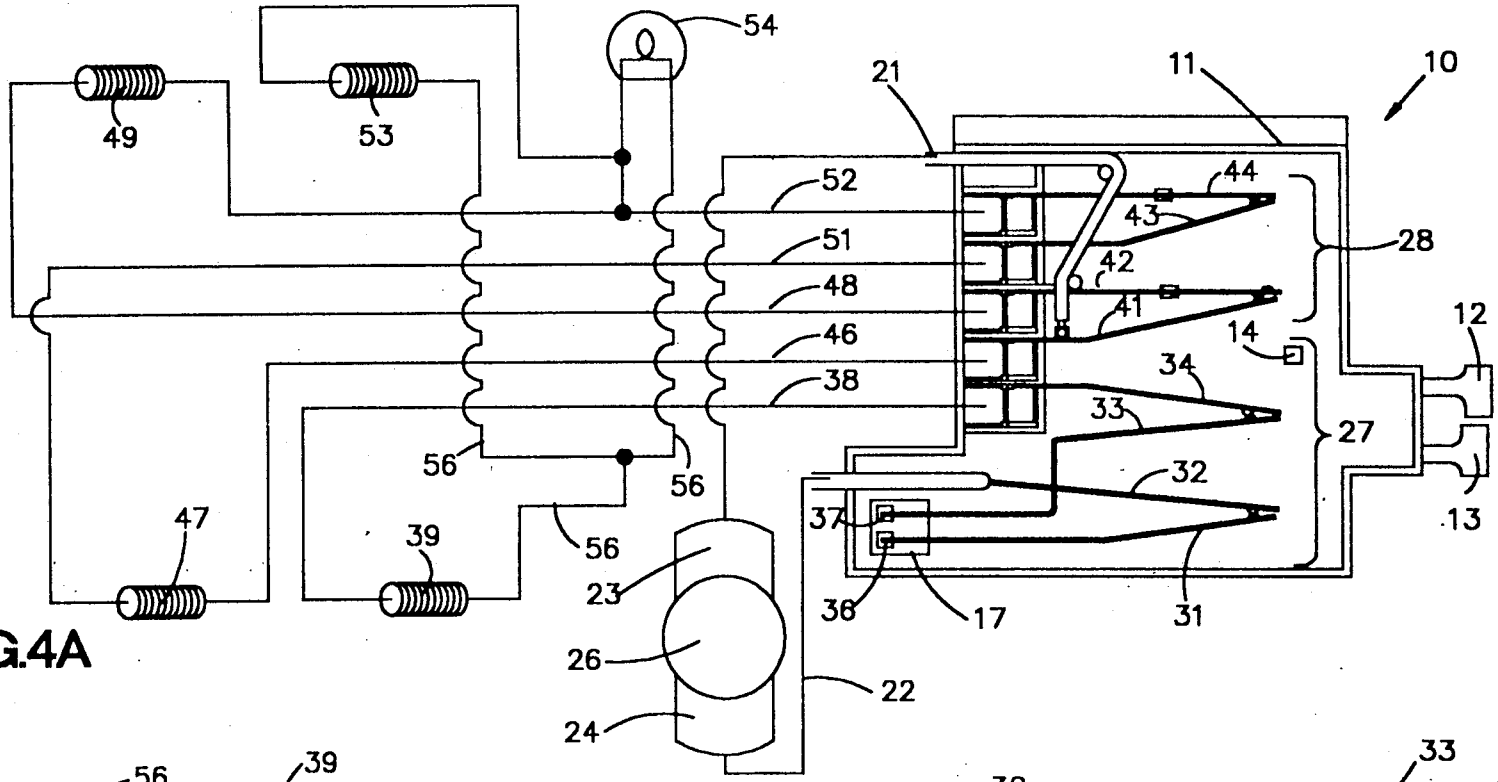
Figure 4B:
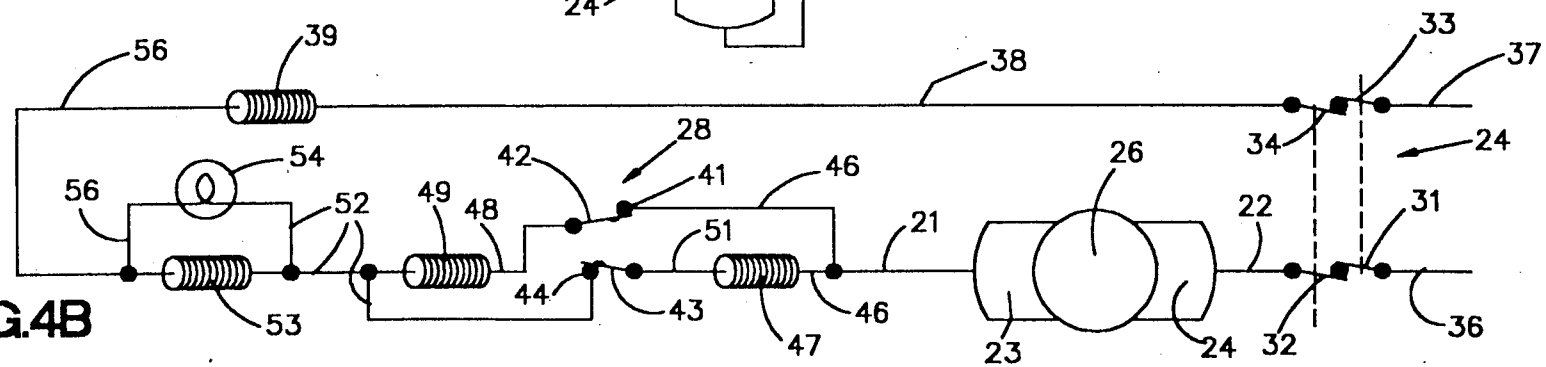

When the power switch is turned on while the switch components are in the position of FIGS. 3, 3A and 3B, the power switch operating cam 79 moves the contact support arm 31 into engagement with the enabled contact support arm 32 and the contact support arm 33 into engagement with the enabled contact support arm 34. In this condition, illustrated in FIGS. 4, 4A and 4B, the motor runs at its high speed.

Figure 5:
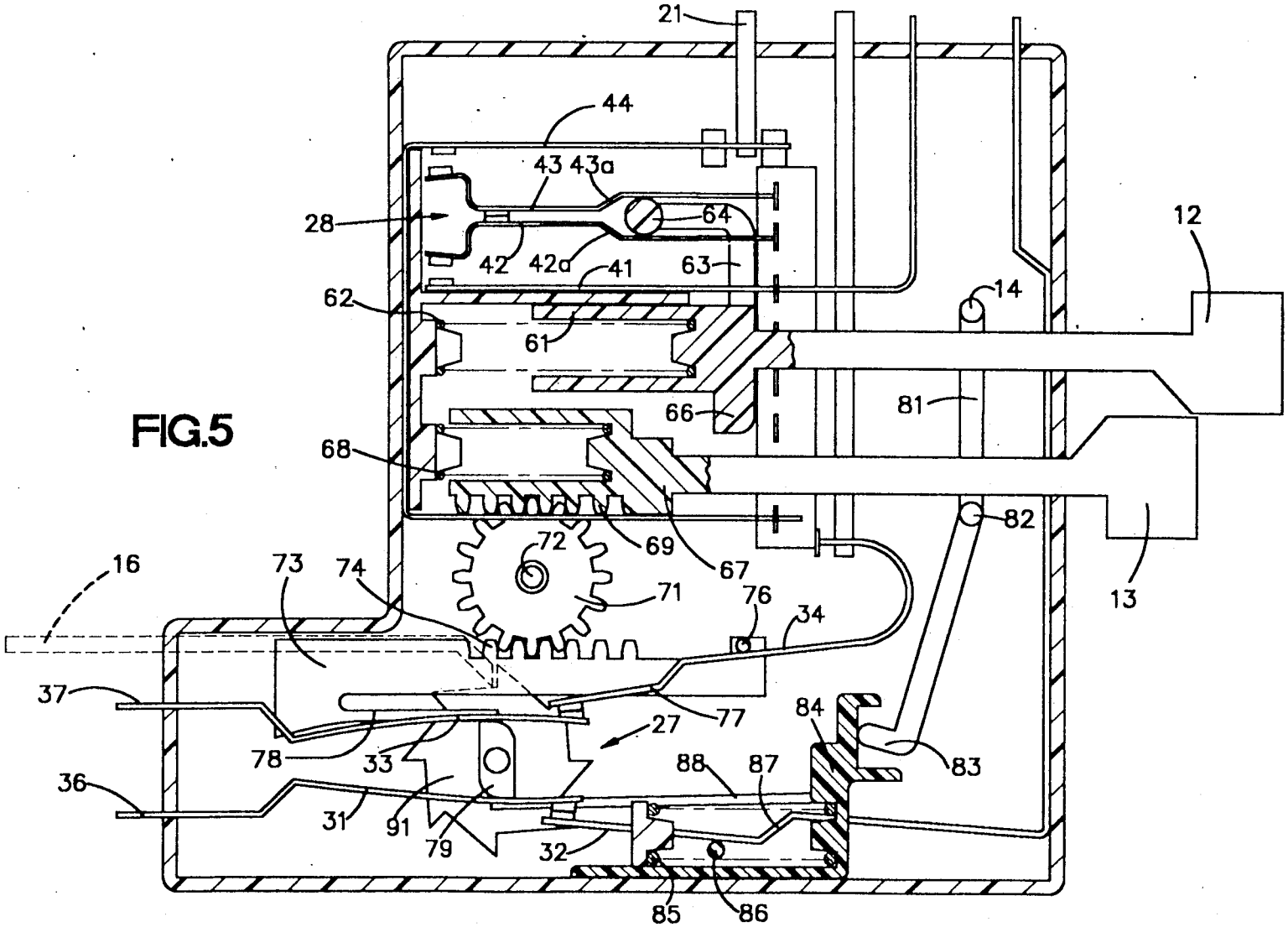
FIGS. 5, 5A, and 5B are respectively similar to the preceding figures, but illustrate the switch in a condition in which a low-speed accessory is mounted on the inlet, an accessory is mounted on the outlet, and the power switch is in the ON position.
Figure 5A:
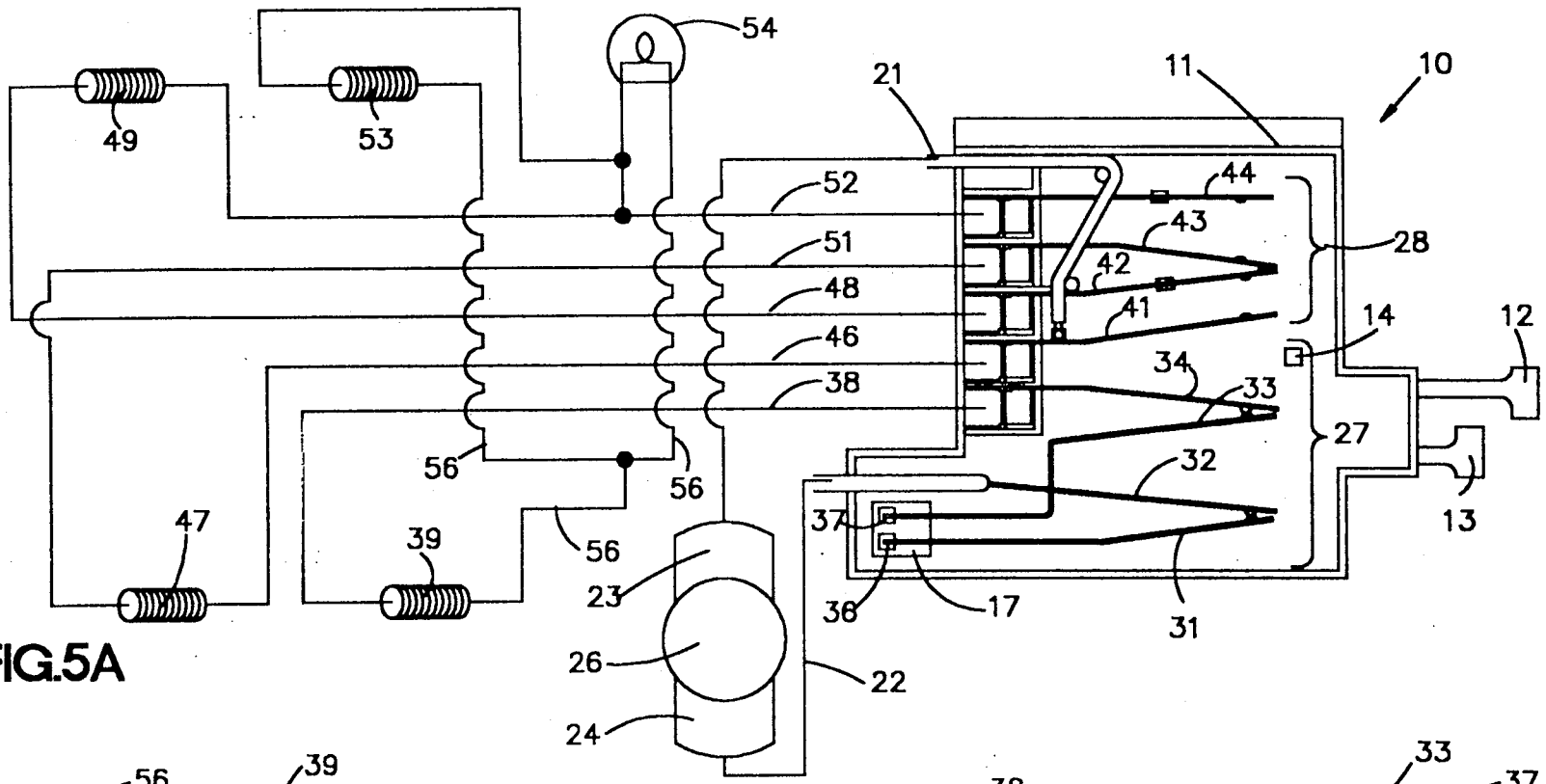
Figure 5B:
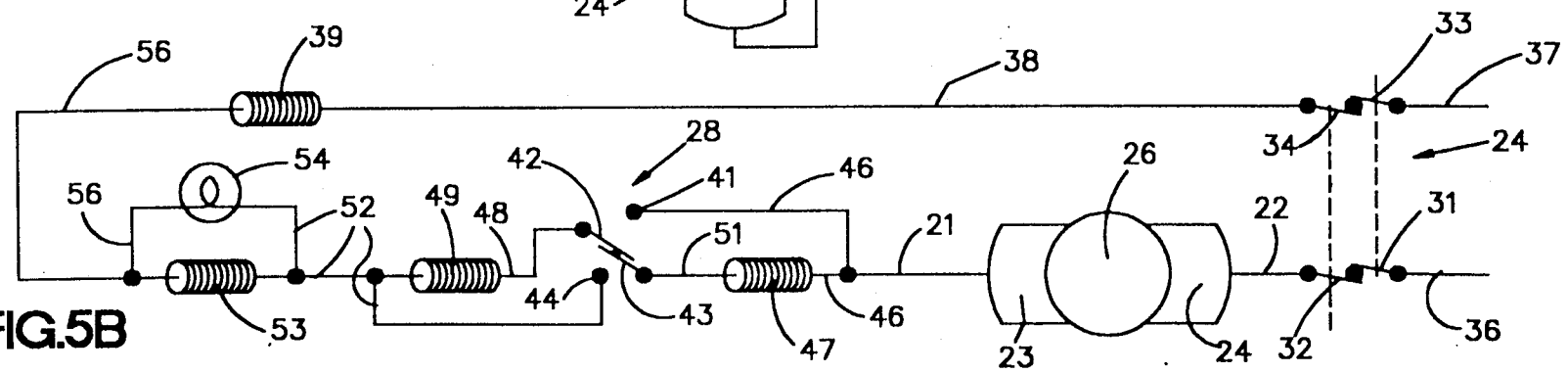

FIGS. 5, 5A, and 5B illustrate the operating conditions when the motor is operated at slow speed. In such condition, the high-speed sensor remains in its extended position when a low-speed accessory is installed. Therefore, the operating projection 64 is in its low-speed operating position and the two contact support arms 42 and 43 engage each other. This connects all of the field coils 47, 49, 53, and 39 in series. In such condition, the low-speed sensor 13 has been moved to the left by the low-speed accessory, so the slide 73 has moved to the right to position the contact support arm 34 in its enabled position, in which it engages the contact support arm 33 in a power switch ON condition. Similarly, in FIG. 5, the outlet sensor 14 establishes that an outlet accessory is installed on the cleaner outlet and the contact support arm 32 is in its enabled position and engages the contact support arm 31.

In both running conditions, the headlight of the cleaner 54 is energized.

Figure 6:
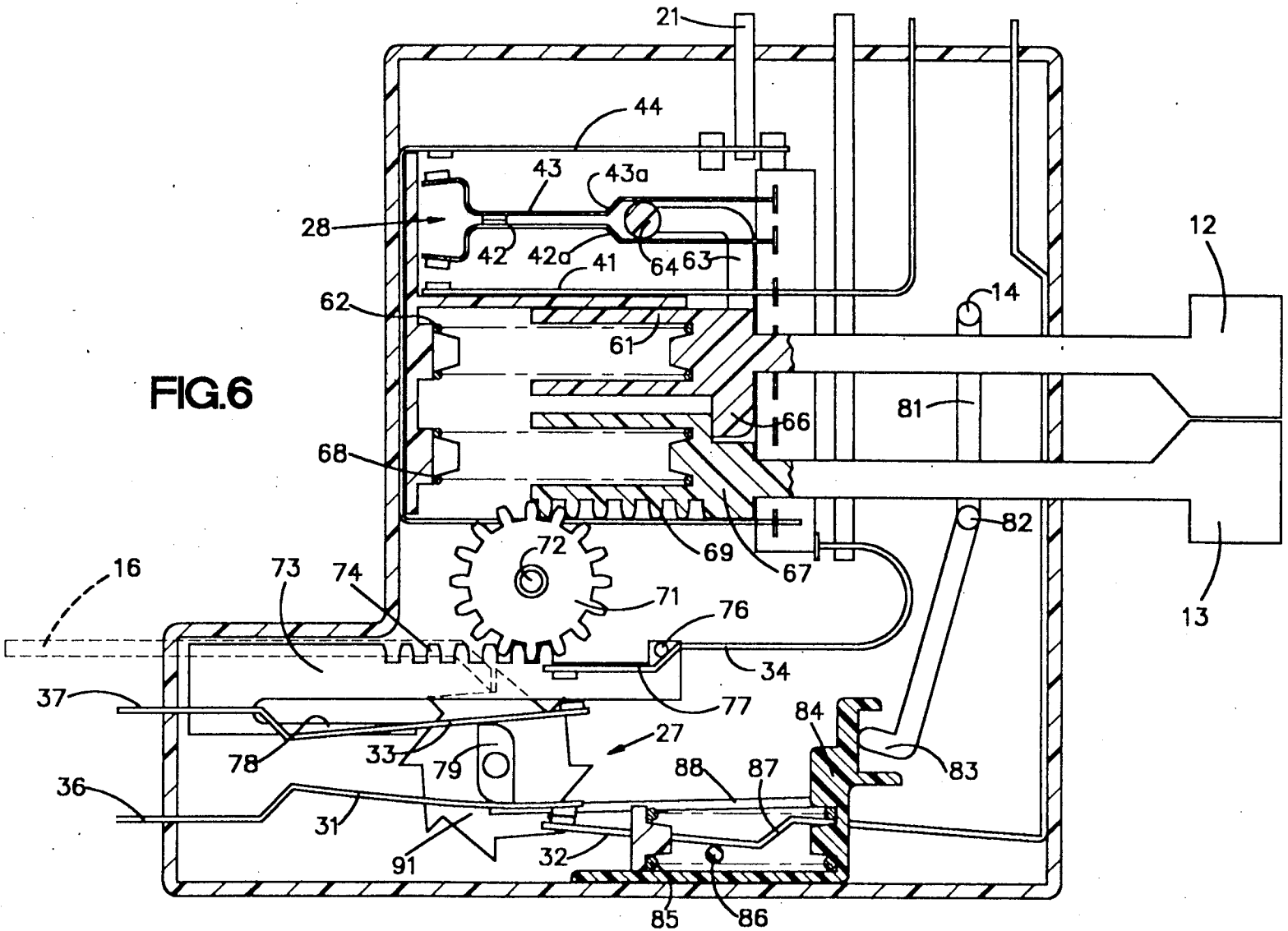
FIGS. 6, 6A, and 6B are respectively similar to the preceding figures, but illustrate the switch in a condition in which an accessory is not mounted on the inlet, an accessory is mounted on the outlet, and the main power switch is in its ON position.
Figure 6A:
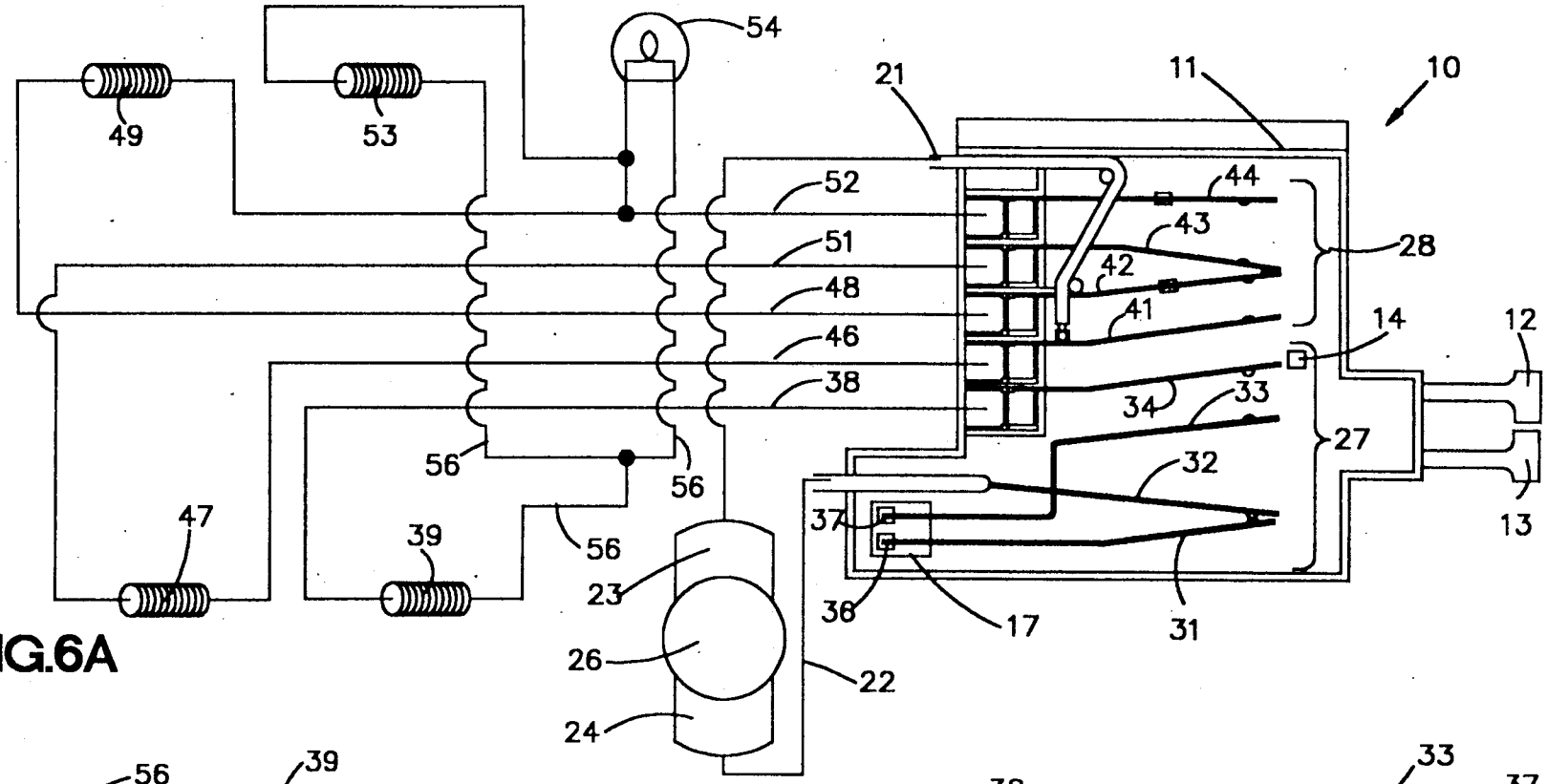
Figure 6B:
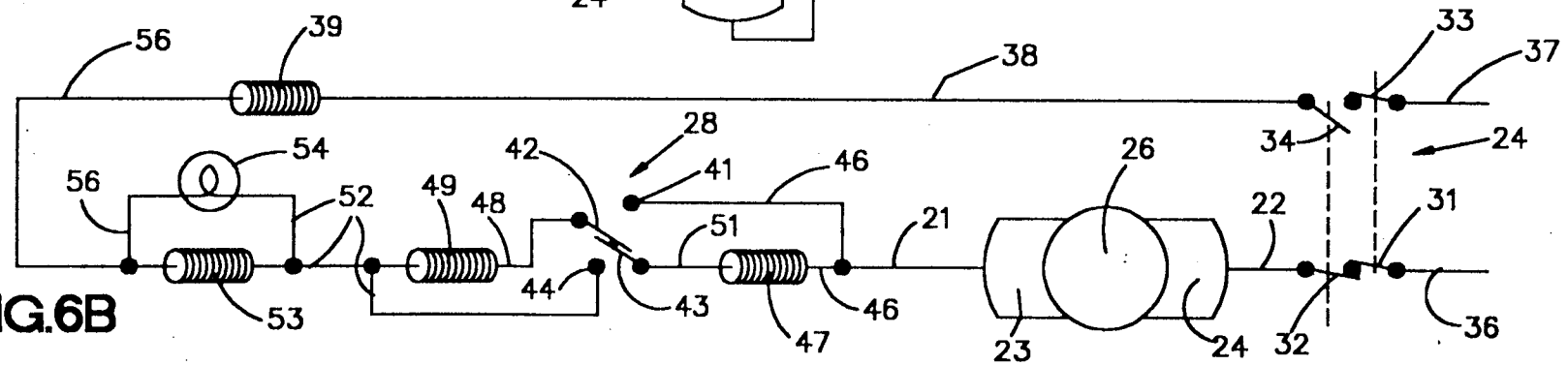

FIGS. 6, 6A, and 6B illustrate the condition of the control switch if the power switch operating cam 79 is in its ON position, but there is no accessory installed on the inlet of the cleaner. Because no accessory is installed on the inlet of the cleaner, both of the sensors 12 and 13 are extended. In such position, the contact support arm 34 is in its disabled position and is therefore not engaged by the contact support arm 33 even though the power switch operating cam 79 is rotated to its operative position. Therefore, the absence of an accessory on the outlet of the cleaner prevents operation of the motor.

Figure 7:
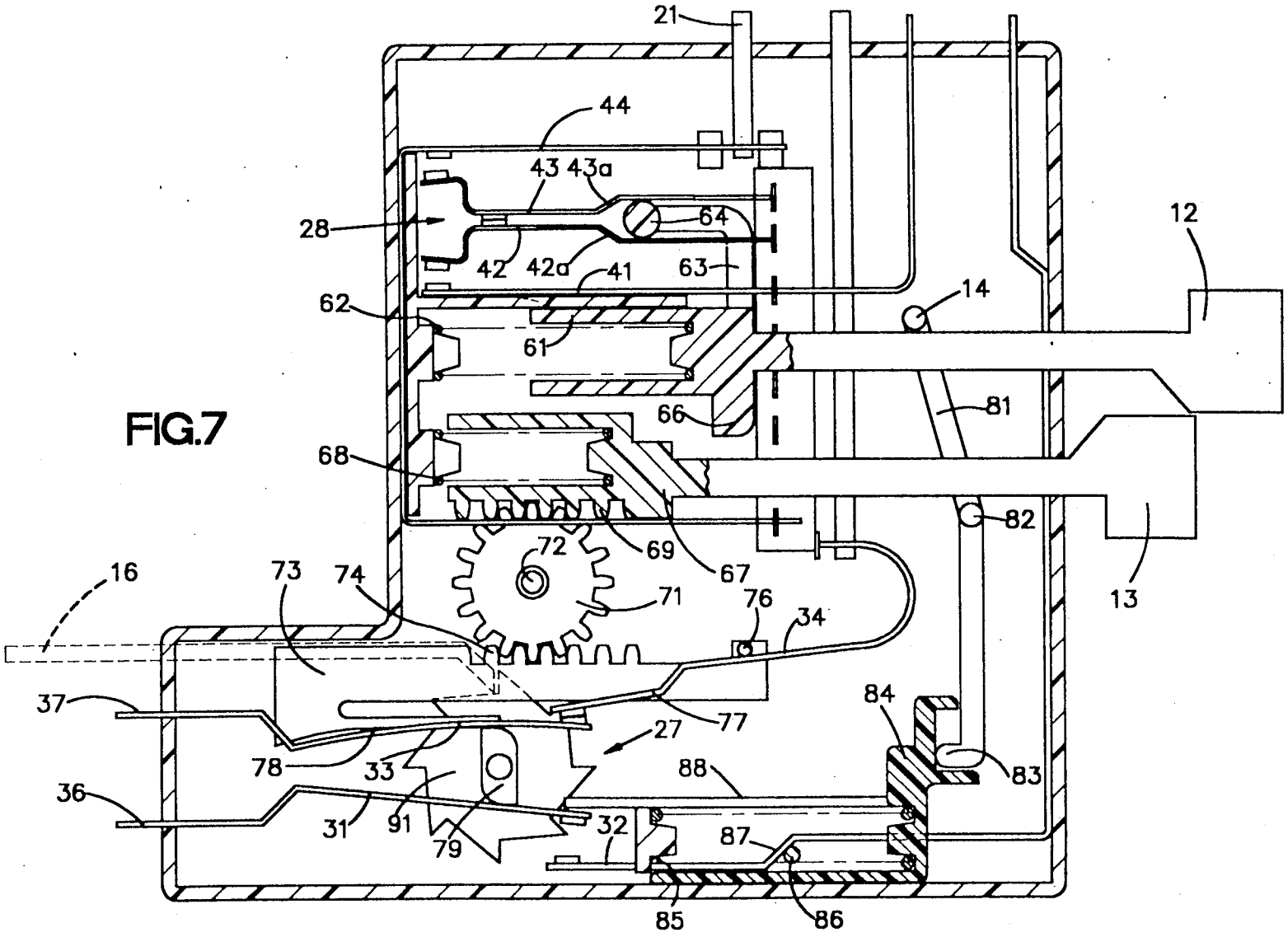
FIGS. 7, 7A, and 7B are respectively similar to the preceding figures, but illustrate the switch in a condition in which the low-speed accessory is mounted on the inlet of the cleaner, an accessory is not mounted on the outlet of the cleaner, and the main power switch is in its ON position.
Figure 7A:
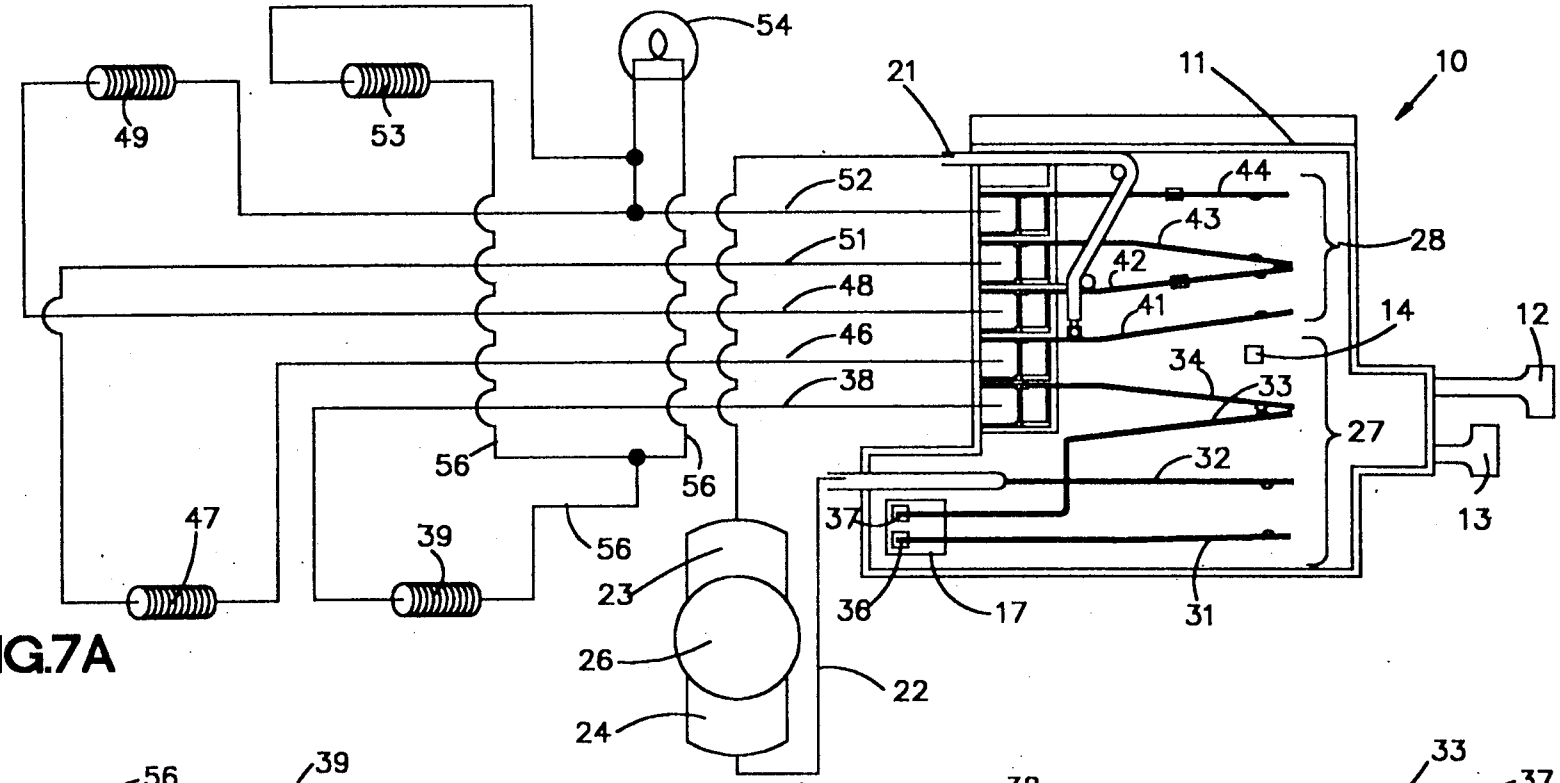
Figure 7B:
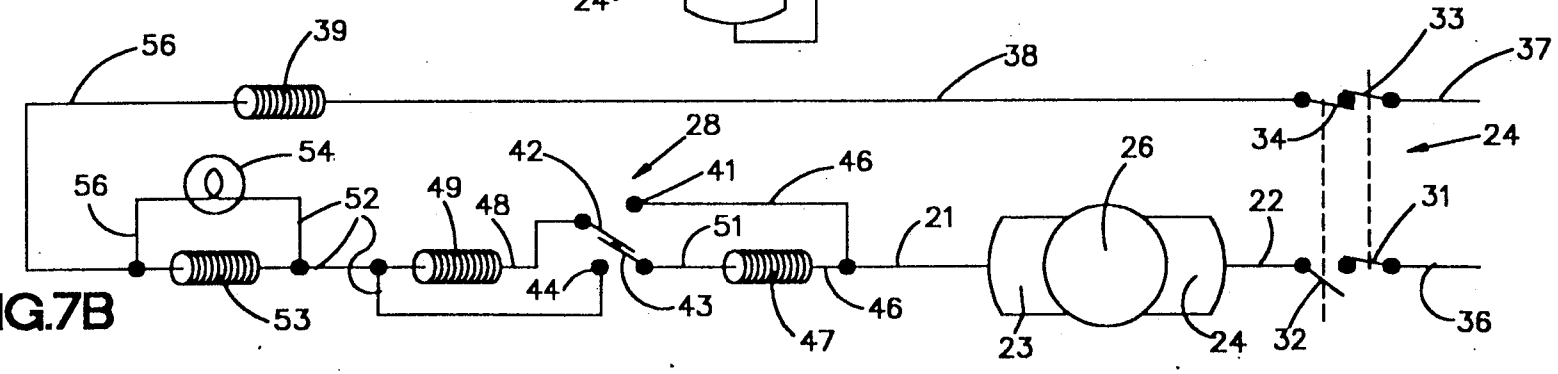

FIGS. 7, 7A, and 7B illustrate a control switch condition which exists when an accessory is mounted on the inlet of the cleaner but an accessory is not mounted on the outlet of the cleaner. In this particular illustrated condition, a low-speed accessory is mounted on the inlet so that the contact support arms 42 and 43 engage. However, because there is no accessory at the cleaner outlet, the slide 84 remains in its righthand position and the contact support arm 32 remains in its disabled position, preventing full closure of the power switch and thereby preventing operation of the motor.

With the present invention, a simple, low-cost control switch is provided which can be easily installed and interconnected with the motor. Further, since motor operation can be instituted only by the power switch 24, and not by the high-speed/low-speed selector switch 28, the contacts of the high-speed/low-speed selector switch are formed of less expensive material to reduce the cost of the control switch.

Still further, with this control switch, the motor cannot be operated unless an accessory is mounted on the inlet of the cleaner and the outlet of the cleaner. Further, with this control switch, the proper operating speed of the motor is automatically provided by the particular accessory installed on the inlet. For example, when a floor cleaning nozzle having a beater brush therein is installed on the cleaner inlet, it automatically establishes the slow speed operation of the motor. However, when an accessory, such as a hose accessory, is connected to the cleaner inlet, high-speed operation is automatically provided.

Finally, the control switch functions to prevent premature operation of the motor in the event that the power switch is left in the ON position during the installation of an accessory. The installation itself automatically moves the power switch to the OFF position, preventing premature motor operation. This also ensures that the engagement of the various contacts of the high-speed/low-speed switch cannot cause the motor to start. Therefore, the contacts of the high-speed/low-speed switches 28 are never subjected to the high surge of electrical power occurring during motor starting and stopping operations.

Although the preferred embodiment of this invention has been shown and described, it should be understood that various modifications and rearrangements of the parts may be resorted to without departing from the scope of the invention as disclosed and claimed herein.

What is claimed is:

1. A control switch for an electrical appliance having a removable accessory, said switch comprising:

a) an electrical switch assembly defining a switch input and a switch output and an interruptable electric current path between said switch input and said switch output, said switch output being electrically coupled to an electrically actuatable component of said appliance;

b) said switch input being adapted for connection to an external source of electric power;

c) said switch assembly further comprising:

i) a first contact assembly including a first contact movable between an enabled position and a disabled position;

ii) an ON/OFF contact assembly including an ON/OFF contact movable between an ON position and an OFF position, said contacts being relatively positioned such that they make contact only when said first contact is in its said enabled position and said ON/OFF contact is in said ON position;

iii) said contact assemblies comprising conductive means coupling said first and said ON/OFF contacts to interrupt said current path between said switch input and said switch output when said contacts are not in contact with one another, and for completing said interruptable current path when said contacts are in contact with one another;

iv) an ON/OFF switch and associated first linkage for moving said ON/OFF contact between said ON and said OFF positions;

v) structure for biasing said first contact toward said disabled position; and, vi) second linkage responsive to engagement of said removable accessory with said appliance for moving said first contact to said enabled position.

2. The switch of claim 1, wherein:

a) said appliance includes means for operating said appliance at different operating speeds;

b) said appliance further comprising speed select circuitry switchable between low speed and high speed operating modes;

c) said switch further comprising speed select linkage for switching said speed select circuitry between said high and said low speed modes;

d) said removable accessory having means for actuating said speed select linkage to switch said appliance to said high speed operating mode in response to engagement of said accessory with said appliance; and, e) a second removable accessory having means for actuating said speed select linkage to set said speed select circuitry for operating said appliance in said low speed mode in response to engagement of said second removable accessory with said appliance.

3. The switch of claim 2, wherein:

said speed select linkage comprises mechanical sensors movable in response to accessory engagement with said appliance.

4. A control switch for an electric motor driven appliance having a body and a removable accessory adapted for engagement with said appliance, said switch comprising:

a) an electrical switch assembly defining a switch input and a switch output and an interruptable electric current path between said switch input and said switch output, said switch output being electrically coupled to said motor;

b) said switch input being adapted for coupling to an external electric power source;

c) said switch assembly comprising:

i) switch apparatus and circuitry defining OFF and ON configurations for selectively interrupting and completing said current path when said switch is in said OFF configuration and said ON configuration, respectively; and, ii) linkage responsive to the act of engaging said accessory with said appliance for changing the configuration of said power switch from ON to OFF.

5. A control switch for an appliance having an electric motor for operating the appliance, the motor being capable of high speed operation and low speed operation, a first removable accessory requiring low speed operation and a second removable accessory requiring high speed operation, said switch comprising:

a) an electrical switch assembly defining a switch input and a switch output and an interruptable electric current path between said switch input and said switch output, said switch output being coupled to said motor;

b) said switch input being adapted for connection to an external source of electric power;

c) said switch assembly further comprising:

i) speed select apparatus and circuitry coupled between said electric motor and the region of said appliance body, said speed select apparatus and circuitry being responsive to engagement of said accessory with said appliance to operate said motor in one of said speed modes, and being responsive to engagement of said second accessory to cause said motor to operate at the other of said speed modes;

ii) apparatus and circuitry for interrupting said current path in response to the absence of engagement of an accessory with said appliance.

6. The switch of claim 5, further comprising:

a) a power switch and linkage capable of assuming an ON position, wherein said current path is completed and an OFF position wherein said current path is interrupted; and, b) means coupled to said power switch for changing the state of said power switch from its ON condition to its OFF condition in response to the act of engagement of an accessory with said appliance.

7. The switch of claim 5, further comprising:

means for assuring interruption of said current path while said speed select apparatus and circuitry is changed between said high and low speed operating modes.

8. The switch of claim 5, further comprising:

means for interrupting said current path in response to the absence of engagement of both said first removable accessory and said second removable accessory.

9. The switch of claim 5, wherein said power switch comprises a double pole switch operable when in its said OFF position to isolate said motor from said external source of electrical power.

* * * * *